US005666464A

United States Patent [19]

Serizawa

[11] Patent Number: 5,666,464

[45] Date of Patent: Sep. 9, 1997

[54] SPEECH PITCH CODING SYSTEM

[75] Inventor: Masahiro Serizawa, Tokyo, Japan

[73] Assignee: NEC Corporation, Tokyo, Japan

[21] Appl. No.: 296,419

[22] Filed: Aug. 26, 1994

[30] Foreign Application Priority Data

Aug. 26, 1993 [JP] Japan ..... 5-211269

[51] Int. Cl.[6] ..... G10L 3/02

[52] U.S. Cl. ..... 104/207; 704/223

[58] Field of Search ..... 395/2.16, 2.32, 395/2.28

[56] References Cited

U.S. PATENT DOCUMENTS

| | | | |
|---|---|---|---|
| 3,947,638 | 3/1976 | Blankship | 179/1 |
| 4,004,096 | 1/1977 | Bauer et al. | 179/1 |
| 4,561,102 | 12/1985 | Prezas | 381/49 |
| 4,731,846 | 3/1988 | Secrest et al. | 381/49 |
| 4,879,748 | 11/1989 | Picone et al. | 381/49 |
| 4,885,790 | 12/1989 | McAulay | 381/36 |
| 4,912,764 | 3/1990 | Hartwell et al. | 381/38 |
| 5,226,108 | 7/1993 | Hardwick et al. | 395/2 |
| 5,233,660 | 8/1993 | Chen | 381/38 |
| 5,293,449 | 3/1994 | Tzeng | 395/2.32 |
| 5,307,441 | 4/1994 | Tzeng | 395/2.31 |

FOREIGN PATENT DOCUMENTS

| | | | |
|---|---|---|---|
| 4-270398 | 3/1992 | Japan | G10L 9/14 |
| 4-115300 | 4/1992 | Japan | G10L 9/00 |
| 4-305135 | 10/1992 | Japan | G01L 9/14 |

OTHER PUBLICATIONS

ICASSP-94–IEEE International conference on Acoustics, Speech and Signal processing, Ozawa et al., "M-LCELP speech coding at 4 kbps", pp.I/269–72 vol. 1 Apr. 1994.

ICASSP-92: 1992 IEEE International Conference on Acoustics, Speech and Signal Processing, Lobo et al., "Evaluaton of a glottal ARMA model of speech production", pp. 13–16 vol. 2 Mar. 1992.

ICASSP 90. 1990 International Conference an Acoustics, Speech and Signal Processing, Tseng, "An Analysis-by--Synthesis linear predictive model for narrowband speech coding", pp. 209–212 vol. 1 Apr. 1990.

Mano et al., "Studies on a Halfrate Speech Codec for Mobile Telephones", Technical Report of IEICe, SP 92–133, pp. 1–8. Feb. 1993.

Schroeder et al., "Code-Excited Linear Prediction (CELP): High-Quality Speech at Very Low Bit Rates", IEEE, 1985, pp. 937–940.

Gerson et al., "Techniques for Improving the Performance of CELP Type Speech Coders", IEEE, 1991, pp. 205–208.

*Primary Examiner*—Allen R. MacDonald
*Assistant Examiner*—Richemond Dorvil
*Attorney, Agent, or Firm*—Foley & Lardner

[57] ABSTRACT

A plurality of pitch period transition paths are extracted by a pitch tracking over a frame, and a path of a minimum average prediction gain over the frame is selected from the extracted paths. A subsequent preliminary pitch selection may be executed in a sub-frame processing to select a plurality of candidates from the neighborhood of the pitch of the transition path selected for each sub-frame by using the inner product of the input speech signal and each codevector. Finally, a pitch period having a minimum waveform distortion is selected for each sub-frame.

5 Claims, 2 Drawing Sheets

SPEECH PITCH CODING SYSTEM

BACKGROUND OF THE INVENTION

The present invention relates to a speech pitch coding system for high quality coding of a speech signal at a low bit rate, particularly 4 kb/sec or lower.

A prior art speech coding system codes a speech signal based upon characteristic parameter data obtained for each frame (with a length of 40 msec., for instance) of the speech signal and characteristic parameter data obtained for each of sub-frames (with a length of 8 msec., for instance) as further divisions of the frame. The system comprises two excitation sources, i.e., an adaptive codebook produced by repeating a previous excitation signal at a pitch period and an excitation source codebook consisting of a previously produced signal, and produces a synthesized excitation signal by passing the excitation signal through a linear prediction synthesis filter. The synthesis filter is constructed using a filter coefficient set (for instance, a linear prediction filter coefficient set) obtained through analysis of a present frame input speech to be quantized. As such coding system, a CELP (Code-Excited LPC coding) system is well known, which is disclosed in, for instance, a treatise by M. Schroeder and B. Atal entitled "Code-Excited Linear Prediction: High Quality Speech at Very Low Bit Rates", IEEE Proc., ICASSP-85, pp. 937–940, 1985).

In another prior art system, the pitch coding in a small amount of operations by a pitch preliminary selection is performed. As such systems, there are a two-stage retrieval system (disclosed in Japanese Patent Laid-Open Publication No. Heisei 4-305135), which comprises steps of a pitch preliminary selection step in an open loop by using auto-correlation coefficients of a residual signal and a pitch final selection step from selected candidates by using a closed loop distortion, a two-stage retrieval system (disclosed in Japanese Patent Laid-Open No. Heisei 4-270398), which comprises steps of a pitch preliminary selection step in an open loop by using auto-correlation coefficients of an input signal and a final pitch selection step from delays close to selected candidates using a closed loop distortion, and a three-stage retrieval system (disclosed in TECHNICAL REPORT OF IEICE. SP92-133, 1993-02, Para. 5.1.2), which comprises steps of a preliminary pitch selection step in an open loop by using auto-correlation coefficients of a residual signal, a subsequent pitch preliminary selection step in a closed loop with sole inner product of an input signal and each codevector, and a pitch final selection step from selected candidates using a closed loop distortion.

In the above prior art systems, however, the pitch preliminary selection is performed in each sub-frame processing. Therefore, if the number of candidates in the pitch final selection is excessively reduced, a pitch with a locally small waveform distortion may be selected, increasing the speech quality deterioration of the coded speech. To avoid this problem, a certain number of candidates is required, thus making it difficult to reduce the amount of operations involved.

SUMMARY OF THE INVENTION

An object of the present invention is therefore to provide a speech pitch coding system capable of permitting a pitch coding with a small amount of operations compared with the prior art.

According to one aspect of the present invention, there is provided a speech pitch coding system for coding a speech signal by using characteristic parameters obtained for each frame of the speech signal and characteristic parameters obtained for each of sub-frames as further divisions of the frame, and for synthesizing a speech signal by a linear prediction synthesis filter in which excitation source signals of an adaptive codebook obtained by repeating a previous excitation signal at a pitch period and an excitation codebook consisting of a preliminary produced signal are supplied, comprising: a pitch tracking means for extracting a pitch period for each unit longer than the sub-frame, and a pitch period final selection means for finally selecting a pitch period having a minimum waveform distortion, obtained through the linear prediction synthesis filter, for each of the sub-frames, among from pitch periods in the neighborhood of the pitch period extracted in the pitch tracking means.

According to another aspect of the present invention, there is provided a speech pitch coding system for coding a speech signal by using characteristic parameters obtained for each frame of the speech signal and characteristic parameters obtained for each of sub-frames as further divisions of the frame, and for synthesizing a speech signal by a linear prediction synthesis filter in which excitation source signals of an adaptive codebook obtained by repeating a previous excitation signal at a pitch period and an excitation codebook consisting of a preliminary produced signal are supplied, comprising: a pitch tracking means for extracting a pitch period for each unit longer than the sub-frame, a pitch period preliminary selection means for extracting, for each of the sub-frames, pitch period candidates with respect to a pitch period in the neighborhood of the pitch period extracted in the pitch tracking section means, and a pitch period final selection means for selecting a pitch period having a minimum waveform distortion among from the pitch period candidates extracted in the pitch preliminary period selection means through the linear prediction synthesis filter.

The present invention makes use of the fact that the pitch period of a speech signal is not changed suddenly. A plurality of pitch period transition paths are extracted by a pitch tracking over a frame, and a path of a minimum average prediction gain over the frame is selected from the extracted paths. In another aspect in which a subsequent preliminary pitch selection is executed in a sub-frame processing, a plurality of candidates are selected from the neighborhood of the pitch of the transition path selected for each sub-frame by using the inner product of the input speech signal and each codevector. Finally, a pitch period having a minimum waveform distortion is selected for each sub-frame. In the above way, pitch candidates are reduced to a single candidate in the pitch tracking to greatly reduce the amount of operations. Further, since the pitch tracking is performed, it is possible to obtain pitch period transmission bit reduction by expressing the pitch period with the difference between the pitch period for the sub-frame and that for the previous sub-frame.

As shown, with the speech pitch coding system according to the present invention, it is possible to obtain high quality pitch coding with a very small amount of necessary operations compared with the prior art system and also such that it is prevented the selection of a minimum pitch of a locally waveform distortion. It is also possible to obtain pitch coding with a more small amount of transmission bits.

Other objects and features of the present invention will be clarified from the following description with reference to the attached drawings.

DETAILED DESCRIPTION OF THE PREFERRED EMBODIMENTS

Now, embodiments of the present invention will be described with reference to the drawings.

Figure 1:
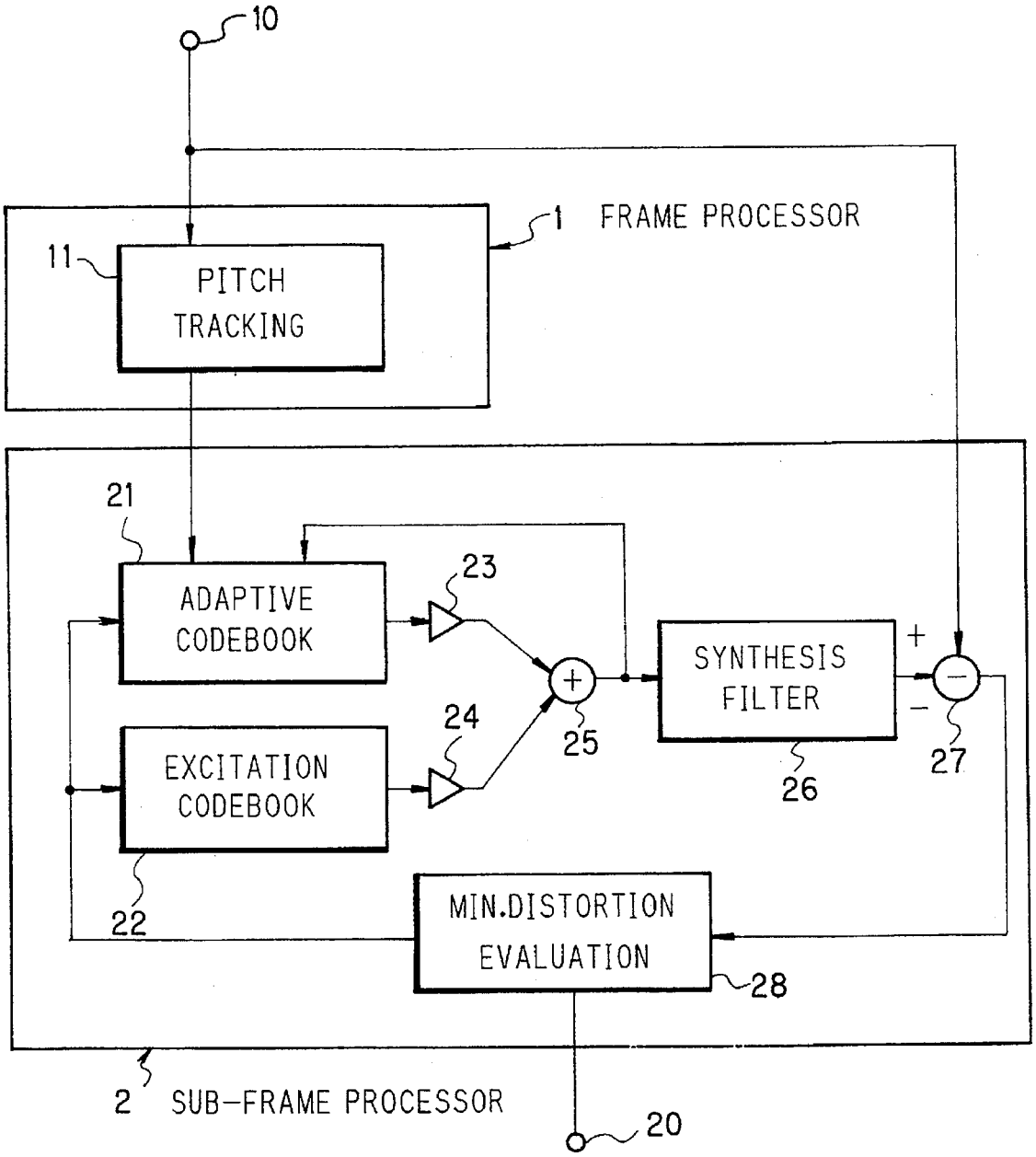
FIG. 1 is a block diagram showing a first embodiment of the present invention.

FIG. 1 is a block diagram showing a first embodiment of the present invention.

A speech signal input to an input terminal 10 is supplied to a pitch tracking section 11 in a frame processor 1 for the pitch tracking in each frame, and resultant pitch tracking path is supplied to a sub-frame processor 2. In a pitch tracking method, with a predetermined frame (with a length of 40 msec., for instance) and sub-frames (with a length of 8 msec., for instance) as divisions of the frame, a pitch tracking path with a minimum waveform distortion or a maximum average pitch prediction gain is selected from $B^N$ combination of pitch tracking paths, where B is the number of bits of pitch coding in each sub-frame and N is the number of sub-frames in the frame. Since this method as such requires enormous operations, for example, the amount of operations can be extremely reduced by adopting a method, in which the pass is determined by successively selecting pitches from any one of the sub-frames.

Next, in a sub-frame processor 2, an adaptive codebook section 21 produces pitch candidates (for instance, around five pitch candidates with index numbers) in the neighborhood of the pitch corresponding to each sub-frame of the pitch tracking path obtained in the frame processor 1. Then, a minimum distortion evaluation section 28 selects the minimum waveform distortion one of combinations of the vectors corresponding to the pitch candidates among adaptive codevectors accumulated in the adaptive codebook section 21 and excitation codevectors accumulated in an excitation codebook section 22, and supplies the index of the selected combination to an output terminal 20. The waveform distortion is calculated by using a difference obtained from a subtractor 27 which takes the difference between the input speech signal and a synthesized speech signal, obtained by passing an excitation signal obtained in an adder 25 through the amplitude adjustment and the addition of outputs of multipliers 23 and 24 which multiply the adaptive and excitation codevectors in each combination through a synthesis filter 26.

Figure 2:
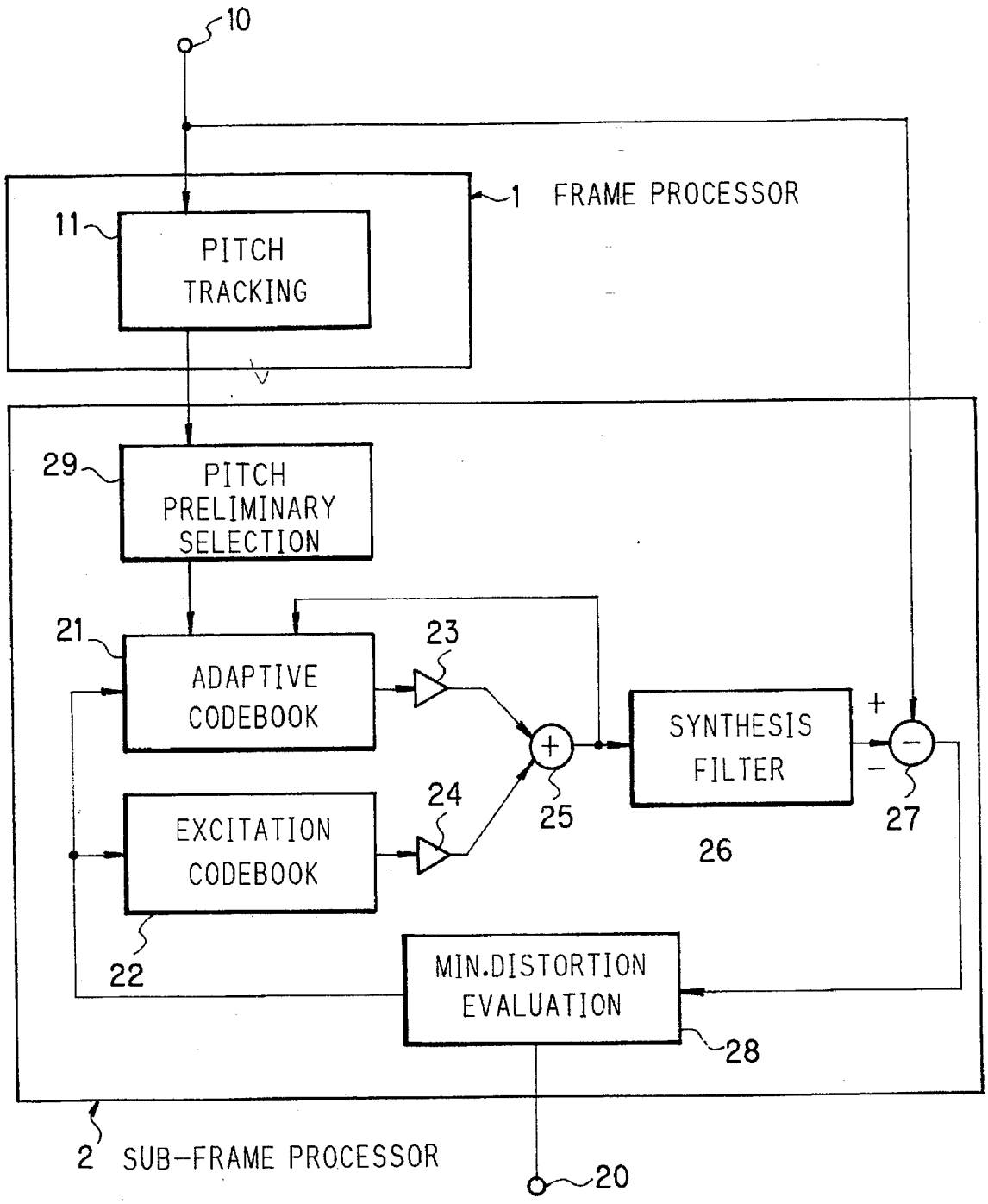
FIG. 2 is a block diagram showing a second embodiment of the present invention.

FIG. 2 is a block diagram showing a second embodiment of the present invention.

This embodiment is the same as the preceding first embodiment except for that the sub-frame processor further includes a pitch preliminary selection section 29. A pitch preliminary selection section 11 further executes the pitch preliminary selection with respect to each sub-frame in the neighborhood of the pitch tracking path obtained in the pitch tracking section 11. For the pitch preliminary selection, either of the prior art methods noted before is effective.

As has been described in the foregoing, according to the present invention it is possible to reduce the amount of operations in the pitch coding compared with the prior art methods.

What is claimed is:

1. A speech pitch coding system for coding an input speech signal by using characteristic parameters obtained for each frame of the input speech signal and characteristic parameters obtained for each of sub-frames as further divisions of each frame, and for synthesizing a processed speech signal to obtain a synthesized speech signal by a linear prediction synthesis filter in which excitation source signals of an adaptive codebook obtained by repeating a previous excitation signal at a pitch period and an excitation codebook which includes a preliminary produced signal are supplied, comprising:

a frame processor for pitch tracking by performing, with each frame of the input speech signal and the sub-frames as divisions of each frame, for selecting a pitch tracking path with one of a minimum waveform distribution and a maximum average pitch prediction gain from $B^N$ combination of pitch tracking paths, where B is a number of bits of pitch coding in each sub-frame and N is a number of sub-frames in each frame;

a pitch candidate producer for producing a predetermined number of pitch candidates in a neighborhood of a pitch corresponding to each sub-frame of the pitch tracking path obtained in said frame processor;

a waveform distortion calculator for calculating a waveform distortion by using a difference between the input speech signal and the synthesized speech signal based upon adaptive codevectors in said adaptive codebook and excitation codevectors in said excitation codebook in each combination through said synthesis filter; and a minimum distortion evaluator for selecting a minimum waveform distortion from combinations of the vectors corresponding to the pitch candidates among the adaptive codevectors accumulated in said adaptive codebook and the excitation codevectors accumulated in said excitation codebook, and supplying the selected combination to an output terminal.

2. A speech pitch coding system for coding an input speech signal as set forth in claim 1, further comprising a pitch preliminary selector for executing a pitch preliminary selection with respect to each sub-frame in the neighborhood of the pitch tracking path obtained by said pitch candidate producer.

3. A speech pitch coding system for coding an input speech signal as set forth in claim 1, wherein said frame processor determines the pitch tracking path by successively selecting pitches from any one of the sub-frames.

4. A speech pitch coding system for coding an input speech signal that is divided into a plurality of frames with a plurality of sub-frames in each frame, comprising:

pitch tracking means for determining one of $B^N$ pitch tracking paths which has one of a minimum waveform distortion and a maximum average pitch prediction gain, where B is a number of bits of pitch coding and N is a number of sub-frames in said each frame, wherein a pitch is successively selected from any one of the N sub-frames in said each frame;

pitch candidate producing means for producing a predetermined number of pitch candidates in a neighborhood of the pitch that is successively selected from the one of the N sub-frames in said each frame;

an adaptive codebook for storing a plurality of adaptive codevectors;

an excitation Codebook for storing a plurality of excitation codevectors;

minimum distortion evaluation means for selecting one of a plurality of combinations of vectors corresponding to the pitch candidates among the adaptive codevectors and the excitation codevectors, the one of the plurality of combinations of vectors being selected according to a minimum waveform distortion; and supplying means for supplying an index of the one of the plurality of combinations of vectors to an output terminal.

5. A pitch coding system as set forth in claim 4, further comprising:

a first amplitude adjuster connected to the adaptive codebook and configured to adjust an amplitude of each adaptive codevector output from the adaptive codebook so as to obtain a corresponding amplitude-adjusted adaptive codevector as a result;

a second amplitude adjuster connected to the excitation codebook and configured to adjust an amplitude of each excitation codevector output from the excitation codebook so as to obtain a corresponding amplitude-adjusted excitation codevector as a result;

an adder connected to the first and second amplitude adjusters and configured to add each amplitude-adjusted adaptive codevector to each amplitude-adjusted excitation codevector so as to obtain an added codevector as a result;

a synthesis filter connected to the adder and configured to receive the added codevector and to filter the added codevector in order to obtain a synthesized signal as a result; and a subtractor connected to the synthesis filter and configured to subtract the synthesized signal from the input speech signal in order to obtain a difference signal, wherein the minimum waveform distortion is calculated from the corresponding difference signal for each of the plurality of combinations of vectors.

* * * * *